United States Patent [19]

Keys

[11] Patent Number: 4,606,818

[45] Date of Patent: Aug. 19, 1986

[54] MODIFIED ALCOHOL FROTHERS FOR FROTH FLOTATION OF COAL

[75] Inventor: Robert O. Keys, Columbus, Ohio

[73] Assignee: Sherex Chemical Company, Inc., Dublin, Ohio

[21] Appl. No.: 694,933

[22] Filed: Jan. 25, 1985

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,695,101 | 11/1954 | Booth et al. | 209/166 |
| 3,595,390 | 7/1971 | Booth | 209/166 |
| 4,394,257 | 7/1983 | Wang et al. | 252/61 |

FOREIGN PATENT DOCUMENTS

| | | | |
|---|---|---|---|
| 986504 | 1/1983 | U.S.S.R. | 252/61 |

OTHER PUBLICATIONS

Am Cyanamid—The Chemistry of Acrylonitrile, 2nd Edition, Am Cyanamid Co., Petro Dept., Rockefeller Plaza, New York, Table XX.

Polyethers—Gaylord Norman, Interscience Publishers, John Wiley & Sons, pp. 225-230.

*Primary Examiner*—Bernard Nozick

*Attorney, Agent, or Firm*—Mueller and Smith

[57] ABSTRACT

Disclosed is an improved froth flotation process wherein solid coal particles are selectively separated under coal froth flotation conditions as a froth phase from remaining solid feed particles as an aqueous phase in the presence of a coal particle collector (e.g. a fuel oil), optionally a promoter, and an alcohol frother. The improvement in the present invention is characterized by the alcohol frother comprising the reaction product of a $C_4$–$C_{10}$ diol and a compound selected from the group consisting of an alkylene oxide and an acrylonitrile. The resulting frothing agent has at least one hydroxyl group and provides greater coal recovery than use of the diol as the frothing agent.

13 Claims, No Drawings

MODIFIED ALCOHOL FROTHERS FOR FROTH FLOTATION OF COAL

BACKGROUND OF THE INVENTION

The present invention relates to the froth flotation of finely-divided coal particles for separation of ash therefrom and more particularly to a new frothing agent or frother which enhances the coal recovery in the froth flotation process.

Coalification is a natural process which results in the deposits of combustible carbonaceous solids in combination with some non-combustible mineral matter. Most coal cleaning is carried out by gravity separation methods utilizing jigs, shaking tables, heavy media or cyclones, and like techniques. The fine coal therefrom has been incorporated into clean coal or simply discarded in the past; however, due to economic and environmental considerations gained by recovery of the fine coal fraction, fine coal beneficiation has become a necessity in most coal operations requiring any degree of preparation. Froth flotation is one method which has been practiced for cleaning the fine coal.

The use of froth flotation to effect a separation of pyritic sulfur and ash particles from coal can be achieved only if liberation of these unwanted particles from the coal has taken place. Most high-grade coals are flotable naturally due to their hydrophobic surface and typically only require a frothing agent for effecting flotation. A frothing agent imparts elasticity to the air bubble, enhances particle-bubble attachment so that the coal is buoyed to the surface of the slurry. The floatability of coal can vary within a given seam at a mine depending upon the exposure of the locale to weathering elements or the blending of coals from different seams. Bituminous and lower grade coals either possess an oxidized condition as mined or undergo oxidation (weathering) when the coal is stored or stockpiled for later processing. Coal that has been oxidized does not respond well to froth flotation. As the degree of oxidation increases, coal becomes increasingly hydrophilic and, therefore, less coal readily can be floated. Heretofore, oxidized coal which was not flotable was discarded in the tailing of the flotation process with little attempt to recover this loss being undertaken.

Conventional frothing agents or frothers in the coal flotation process generally have been short-chain alkanols, terpene alcohols such as alpha-terpineol, short-chain glycols, sorbitol derivatives, ethoxylated alcohols, and mixed alkylene oxide glycol ethers. While such alcohol frothers function in the coal float, the need for improved alcohol frothers yet exists. The present invention provides improved high coal recoveries with improvements in coal quality utilizing a novel alcohol promoter which is highly effective and can be inexpensive to manufacture.

BROAD STATEMENT OF THE INVENTION

The present invention is directed to a froth flotation process for beneficiating coal wherein solid coal particles are selectively separated under coal froth flotation conditions as a froth phase from remaining solid feed particles as an aqueous phase in the presence of a coal particle collector (which preferably is a fuel oil) and an alcohol frothing agent or frother. The improvement in such process is characterized by the alcohol frother comprising the reaction product of a $C_4$–$C_{10}$ diol and a compound selected from the group of an alkylene oxide and an acrylonitrile. The resulting modified alcohol frothing agent has at least one hydroxyl group and provides greater coal recovery than use of the diol as the frothing agent.

Advantages of the present invention include the ability to improve recovery of coal particles during the froth flotation process without increasing the proportion of ash in the concentrate. Another advantage is the ability to improve the coal recovery without increasing the proportion of collector and frother used in the float. These and other advantages will become readily apparent to those skilled in the art based upon the disclosure contained herein.

DETAILED DESCRIPTION OF THE INVENTION $C_4$–$C_{10}$ diols for use in synthesizing the modified alcohol frothing agents of the present invention may be primary diol (eg. glycols), but preferably the diol will contain a secondary hydroxyl group. Additionally, while the diols can be linear in structure, preferably the diols will contain alkyl branching, especially methyl branching, in order to enhance coal recovery. Most preferably, the diols will be branched and contain a secondary hydroxyl group. Representative $C_4$–$C_8$ diols which may be used in synthesizing the modified alcohol frothers of the present invention include, for example, 2,2,4-trimethyl-1,3-pentane diol (TMPD), 2-ethyl-1,3-hexanediol, 1,6-hexanediol, neopentyl glycol, butane diol, and the like. The particularly preferred diol is TMPD as the Examples will demonstrate.

The diol is reacted with alkylene oxide or an acrylonitrile compound. Referring to the alkylene oxide compounds, suitable alkylene oxides include, for example, ethylene oxide, propylene oxide, butylene oxide, and higher alkylene oxides. Higher alkylene oxides (i.e. propylene or higher oxides) advantageously are used and propylene oxide is the preferred alkylene oxide. The reaction of alkylene oxides with alcohols is such a well-known reaction that further details will be omitted here. The number of moles of alkylene oxide reacted with the diol generally will range from about 2 to 10 or more moles of alkylene per mole of diol. It should be noted that when the alkoxylated diol frother contains both a secondary and a primary hydroxyl group, the primary hydroxyl group may be capped to leave only the secondary hydroxyl group as the only hydroxyl group on the frother. Suitable capping agents include, for example, methyl chloride, dimethyl sulfate, phenyl isocyanate, methyl isocyanate, and the like and mixtures thereof.

Referring to the nitrile reactant utilized in forming the novel frothers of the present invention, economy and efficiency dictate that acrylonitrile be utilized, although methacrylonitrile, ethacrylonitrile, and like substituted acrylonitriles may find utility in forming the frothers of the present invention. The reaction of acrylonitrile and an alcohol is a specialized type of a Michael reaction known as cyanoethylation. Cyanoethylation is conducted in the presence of a basic catalyst and results in the formation of an ether nitrile. The molar proportions of reactants are adjusted such that at least one hydroxyl group is residual on the reaction product, such hydroxyl group typically coming from the diol. More on cyanoethylation can be found in Fieser and Fieser, *Advanced Organic Chemistry,* p 478, Reinhold Publishing Corporation, New York (1961) and Bruson, *Org.*

*React.*, 5, 79–135 (1949), especially pages 89–95 and 121–128. Regardless of which form of frother is synthesized, the proportion of frother utilized in the flotation process typically ranges from about 0.05 to about 0.5 g/kg of coal feed.

The frothers of the present invention are used with conventional collectors and promoters. Fuel oil is the preferred collector for use in the coal flotation process. Representative fuel oils include, for example, diesel oil, kerosene, Bunker C fuel oil, and the like and mixtures therof. The fuel oil collector generally is employed in a dosage of from about 0.2 to about 2.5 gm/kg of coal feed. The precise proportion of collector depends upon a number of factors including, for example, the size, degree of oxidation and rank of the coal to be floated, and the dosages of the promoter and frother.

The preferred promoters for use in the process are the hydrophobic promoters disclosed in Applicant's copending, commonly-assigned application Ser. No. 585,176, filed Mar. 1, 1984, now U.S. Pat. No. 4,589,980, the disclosure of which is expressly incorporated herein by reference. Such hydrophobic promoters are selected from the group consisting of (a) an aromatic or $C_{10}$–$C_{30}$ aliphatic carboxylic acid or an aliphatic ester thereof; (b) a nitrile; (c) the epoxidized, hydroxylated, oxidized, or alkoxylated derivative of promoter (a) or (b), said promoter (a) and its derivatives being devoid of nitrogen atoms and the alkoxylated derivatives of promoter (a) being $C_3$ or higher alkoxylated derivatives; (d) a $C_{12}$–$C_{30}$ non-frothing fatty alcohol or its $C_3$ or higher alkoxylated derivative; and (e) mixtures thereof. The proportion of such promoters typically is from about 0.01 to about 2 g/kg of solid feed particles.

Of course, conventional promoters can be used in combination with the ether and nitrile alcohols of the present invention. For example, U.S. Pat. No. 4,253,944 shows a promoter which is the condensation product of a fatty acid or fatty acid ester with an ethoxylated or propoxylated amine. U.S. Pat. No. 4,308,133 shows a promoter which is an aryl sulfonate. European patent application No. 891688732, filed Jan. 26, 1980, shows a promoter which is an alkanol amine-tall oil fatty acid condensate. U.S. Pat. No. 4,305,815 shows a promoter which is a hydroxy alkylated polyamine. U.S. Pat. No. 4,278,533 shows a promoter which is a hydroxylated ether amine. U.S. Pat. No. 4,196,092 shows a conditioning agent of a frother and a bis(alkyl)ester of a sulfosuccinic acid salt. United Kingdom Pat. No. 2,072,700 floats coal with a latex emulsion prepared from a hydrocarbon oil with a hydrophobic water-in-oil emulsifier and a hydrophilic surfactant. Canadian Pat. No. 1,108,317 shows anionic surfactants which are fatty sulfosuccinates. Russian Inventor's Certificate No. 882,626 proposes a collector-frother which is an hydroxy, chloro or sulfide derivative of the methyl or ethyl ester of a caproic acid.

Suitable coal for beneficiation by the improved froth flotation process of the present invention includes anthracite, lignite, bituminous, subbituminous and like coals. The process of the present invention operates quite effectively on coals which are very difficult to float by conventional froth flotation techniques, especially where the surfaces of the coal particles are oxidized. The size of the coal particles fed to the process generally are not substantially above about 28 Tyler mesh as larger particles are extremely difficult to float. In typical commercial froth flotation operations, coal particles larger than 28 Tyler mesh, advantageously larger than 100 Tyler mesh, are separated from both inert material mined therewith and more finely divided coal by gravimetric separation techniques. The desirable cut or fraction of coal fed to the process for flotation preferably is initially washed and then mixed with sufficient water to prepare an aqueous slurry having a concentration of solids which promote rapid flotation. Typically, a solids concentration of from about 2% to about 20% by weight solids, advantageously between about 5 and 10 weight percent solids, is preferred. The aqueous coal slurry is conditioned with the collector and promoter, and any other adjuvants, by vigorously mixing or agitating the slurry prior to flotation in conventional manner. It should be noted that promoters can be used in separate form or can be admixed with the collector or the frother for use in the present invention.

Typical commercial coal froth flotation operations provide a pH adjustment of the aqueous coal slurry prior to and/or during flotation to a value of about 4 to about 9 and preferably about 4 to 8. Such pH adjustment generally promotes the greatest coal recovery, though flotation at the natural coal pH is possible. If the coal is acidic in character, the pH adjustment is made generally by adding an alkaline material to the coal slurry. Suitable alkaline materials include, for example, soda ash, lime, ammonia, potassium hydroxide or magnesium hydroxide, and the like, though sodium hydroxide is preferred. If the aqueous coal slurry is alkaline in character, an acid is added to the aqueous coal slurry.

Suitable acids include, for example, mineral acids such as sulfuric acid, hydrochloric acid, and the like. The conditioned and pH-adjusted aqueous coal slurry is aerated in a conventional flotation machine or bowl to float the coal. The frothing agent or frother preferably is added to the aqueous coal slurry just prior to flotation or in the flotation cell itself.

The following examples show how the present invention can be practiced but should not be construed as limiting. In this application, all units are in the metric system, and all percentages and proportions are by weight, unless otherwise expressly indicated. Also, all references cited herein by reference.

IN THE EXAMPLES

Coal subjected to evaluation was comminuted to a particle size of less than 28 Tyler mesh (0.589 mm) and then dispersed in water for conditioning with fuel oil collector and various alcohol frothers for about 1 minute. The floats were conducted at about 6.67% solids slurry of the conditioned coal particles. The coal evaluated was Illinois #6 seam coal which had an initial ash content of about 30% by weight.

EXAMPLE 1

Several modified alcohol frothers were synthesized and evaluated in a coal float at a dosage of about 0.17 g/kg of coal. The frother candidate along with #2 fuel oil collector (dosage of about 0.45 g/kg) were used to condition the coal prior to flotation of the Illinois coal. The unreacted diols were evaluated along with the modified frothers of the present invention and several commercially available frothers. The commercially available comparative frothers were Dowfroth 250 (a polypropylene glycol methyl ether, MW 250, Dow Chemical Company) polypropylene glycol (MW 400), 2-ethyl hexyl alcohol, and methyl isobutyl carbinol (MIBC). The following results were recorded:

TABLE 1

| Test No. | Frother | Yield (wt %) | Ash in Concentrate (wt %) | Coal Recovery (wt %) |
|---|---|---|---|---|
| 32-1 | Dowfroth 250 | 57.0 | 8.7 | 71.1 |
| 32-11 | Polypropylene glycol | 59.7 | 8.2 | 74.4 |
| 32-3 | 2-Ethyl hexyl alcohol | 59.3 | 8.3 | 73.6 |
| 32-4 | MIBC | 41.3 | 7.5 | 51.7 |
| 133-36 | 1,3-Butanediol | 13.2 | 12.9 | 16.4 |
| 133-35 | 1,3-Butanediol + 3.5 PO | 64.6 | 10.3 | 82.4 |
| 133-28 | Neopentyl glycol | 15.1 | 13.3 | 18.8 |
| 133-33 | Neopentyl glycol + Acrylonitrile (mono adduct) | 59.7 | 9.0 | 77.3 |
| 133-26 | Neopentyl glycol + 3PO | 71.2 | 11.1 | 90.0 |
| 133-30 | 1,6-Hexanediol | 16.8 | 12.9 | 21.1 |
| 133-24 | 1,6-Hexanediol + 3PO | 72.1 | 10.9 | 91.4 |
| 133-29 | 2-Ethyl-1,3-hexanediol | 64.0 | 10.8 | 82.0 |
| 133-32 | 2-Ethyl-1,3-hexanediol Acrylonitrile (mono adduct) | 66.2 | 10.5 | 84.3 |
| 133-34 | TMPD | 64.2 | 10.7 | 81.6 |
| 133-31 | TMPD + Acrylonitrile (mono adduct) | 68.6 | 10.4 | 87.5 |
| 133-23 | TMPD + 3PO | 73.4 | 10.9 | 93.0 |

TMPD is 2,2,4-trimethyl-1,3-pentanediol
PO is propylene oxide

The above-tabulated results clearly show the unexpected yet excellent coal recovery results which are obtained when a diol is reacted with an alkylene oxide or acrylonitrile. These results additionally establish the diol range to be from 4 to 10 carbon atoms.

EXAMPLE 2

The preferred TMPD diol was subjected to various modifications and evaluated on the Illinois coal. The float was conducted utilizing 0.17 g/kg of frother and 0.45 g/kg #2 fuel oil collector. The following results were recorded:

TABLE 2

| Test No. | Frother | Yield (wt %) | Ash in Concentrate (wt %) | Coal Recovery (wt %) |
|---|---|---|---|---|
| 32-9 | TMPD | 51.7 | 9.4 | 63.3 |
| 32-10 | TMPD + 3EO | 57.9 | 8.4 | 72.4 |
| 32-12 | TMPD + 3PO (MW 323) | 67.5 | 8.8 | 83.5 |
| 32-2 | TMPD + 3PO (MW 323) | 67.1 | 8.5 | 82.9 |
| 32-6 | TMPD + Acrylonitrile | 59.4 | 8.2 | 73.4 |

TMPD is 2,2,4-trimethyl-1,3-pentanediol
EO is ethylene oxide
PO is propylene oxide The above-tabulated results demonstrate that all forms of modification of the preferred TMPD diol resulted in improved coal recovery yields. Among the various modifications, however, the addition of propylene oxide to the TMPD provided the best coal recoveries in this series of tests.

I claim:

1. In a froth flotation process wherein solid coal particles are selectively separated under coal froth flotation conditions as a froth phase from remaining solid feed particles as an aqueous phase in the presence of a coal particle collector and an alcohol frother, the improvement characterized by said alcohol frother comprising the reaction product of a $C_5$–$C_{10}$ diol and a compound selected from the group consisting of:

(a) between about 2 and 10 moles of an alkylene oxide selected from the group consisting of ethylene oxide, propylene oxide, and mixtures thereof, and (b) an acrylonitrile, the resulting frothing agent having at least one hydroxyl group and providing greater coal recovery than use of said diol as the frothing agent.

2. The process of claim 1 wherein said alkylene oxide comprises propylene oxide.

3. The process of claim 1 wherein said frother comprises the reaction product of 2,2,4-trimethyl-1,3-pentanediol and propylene oxide.

4. The process of claim 1 wherein said frother is used in a dosage ranging from between about 0.05 to about 0.50 g/kg of coal.

5. The process of claim 1 wherein said frother comprises the reaction product of a $C_5$–$C_{10}$ diol and an acrylonitrile.

6. The process of claim 5 wherein said diol is selected from the group consisting of 2,2,4-trimethyl-1,3-pentanediol, 2-ethyl-1,3-hexanediol, 1,6-hexanediol, neopentyl glycol, and mixtures thereof.

7. The process of claim 1 wherein said diol is selected from the group of 2,2,4-trimethyl-1,3-pentanediol, 2-ethyl-1,3-hexanediol, 1,6-hexanediol, neopentyl glycol, and mixtures thereof.

8. The process of claim 7 wherein said diol comprises 2,2,4-trimethyl-1,3-pentanediol.

9. In a froth flotation process wherein solid coal particles are selectively separated under coal froth flotation conditions as a froth phase from remaining solid feed particles as an aqueous phase in the presence of a fuel oil collector and an alcohol frother, the improvement characterized by said alcohol frother comprising the reaction product of a $C_5$–$C_{10}$ diol and a compound selected from:

(a) between about 2 and 10 moles of an alkylene oxide selected from the group consisting of ethylene oxide, propylene oxide, and mixtures thereof; and;

(b) an acrylonitrile, the resulting frothing agent having at least one hydroxyl group and providing greater coal recovery than the use of said diol as the frothing agent.

10. The process of claim 9 wherein said frother comprises the reaction product of a $C_4$–$C_{10}$ diol selected from the group of 2,2,4-trimethyl-1,3-pentane diol, 2-ethyl-1,3-hexanediol, 1,6-hexanediol, neopentyl glycol, and mixtures thereof, and an acrylonitrile.

11. The process of claim 9 wherein said alkylene oxide is propylene oxide.

12. The process of claim 11 wherein said diol is selected from the group of 2,2,4-trimethyl-1,3-pentanediol, 2-ethyl-1,3-hexanediol, 1,6-hexanediol, neopentyl glycol, and mixtures thereof.

13. The process of claim 11 wherein said diol is 2,2,4-trimethyl-1,3-pentanediol.

* * * * *